United States Patent [19]

Lamoreaux, Jr.

[11] 4,192,602

[45] Mar. 11, 1980

[54] PHOTOGRAPHIC FILM CLIP

[76] Inventor: Kenneth C. Lamoreaux, Jr., 30 San Jano, Goleta, Calif. 93017

[21] Appl. No.: 890,648

[22] Filed: Mar. 20, 1978

[51] Int. Cl.[2] ..... G03D 13/10

[52] U.S. Cl. ..... 354/346; 354/340; 24/253

[58] Field of Search ..... 354/340, 344, 345, 346, 354/347, 343, 342; 24/252 R, 253, 137 A, 137 R, DIG. 22

[56] References Cited

U.S. PATENT DOCUMENTS

| | | | |
|---|---|---|---|
| 1,259,458 | 3/1918 | Norris | 24/253 |
| 1,357,151 | 10/1920 | Dalhaus | 24/253 |
| 1,825,310 | 9/1931 | Engstrom | 354/345 |
| 2,425,603 | 8/1947 | Dye et al. | 354/345 |
| 2,535,728 | 12/1950 | Eisner | 354/345 |
| 2,920,365 | 1/1960 | Colangelo | 24/252 R |
| 3,060,536 | 10/1962 | Voie | 24/252 R |
| 3,100,324 | 8/1963 | Tutino et al. | 24/137 R |
| 3,100,326 | 8/1963 | Buck | 354/345 |
| 3,279,479 | 10/1966 | Solomon | 24/252 R X |
| 3,317,973 | 5/1967 | Finkle | 354/345 |
| 3,579,751 | 5/1971 | Jonckheere | 24/252 R |
| 3,914,007 | 10/1975 | Seidler | 24/137 R |
| 4,020,530 | 5/1977 | Sartore | 24/253 |

FOREIGN PATENT DOCUMENTS

| | | | |
|---|---|---|---|
| 364965 | 1/1932 | United Kingdom | 354/340 |

*Primary Examiner*—L. T. Hix
*Assistant Examiner*—Alan Mathews
*Attorney, Agent, or Firm*—Jack C. Munro

[57] ABSTRACT

A clip to suspend within the air an elongated strip of photographic film to facilitate drying of the film after being processed which takes the form of a pair of identical body members hingedly connected together in a facing, mirror image relationship. The fore end of each of the body members have mating irregularly shaped projections with other projections being provided between the body members located in a side-by-side relationship to provide lateral stability of the members when moved between the open and the closed positions. A slot means is provided within the rear portion of each of the body members to facilitate the locating of the clip on a wire or rod in order to suspend the attached photographic film within the air to facilitate drying.

9 Claims, 5 Drawing Figures

PHOTOGRAPHIC FILM CLIP

BACKGROUND OF THE INVENTION

The field of this invention relates to a clip for holding sheet material, and while same may have various other applications, it has been particularly designed to hold such sheet material as elongated strips of photographic films.

As is well known to those skilled in the art, an immense number of photographic films after being developed, fixed and washed, are suspended for drying. The film is commonly held suspended from a film clip which engages the upper end of the film. And it is also common practice to have a weight connected to the lower end of the film by a film clip to hold the film steady and in a vertical position.

Film clips have been previously known and are normally fabricated from sheet metal and engage the film by either piercing the film or by tightly clamping the film. These clamping and piercing devices frequently grasp the film in the photographic sensitive area or impose a warping tendency on the film in the immediate area of the clamping or the piercing.

It is also common that some prior art film clips are fabricated from corrosive materials. The corrosiveness of the materials is undesirable since the corrosiveness results in rust caused by the photographic developing chemicals with the rust then contaminating the photographic film which then appear on the processed film.

In the past it has been attempted to eliminate the rust problem by electroplating the clip with a non-corrosive metal. However, the inherent porosity of the electroplating metal is such that the corrosion is only delayed rather than being prevented and ultimately rust streaks again appear on the processed films.

Also, in the prior art type of film clip which grips rather than pierces the film tends to lose their gripping ability as a result of the lubricating properties of the processing fluids. This results in the film being dropped to the bottom of the processing tank which if not retrieved immediately will result in destroying of the film.

SUMMARY OF THE INVENTION

Most photographic films (35 mm) at the present time have a series of closely spaced apart openings located adjacent each side wall of the film. These openings are for the purpose of movement of the film within the camera. The film clip of the present invention is to suspend the film in the air by means of a pair of projections which interconnect together and pass through a transversely aligned pair of the openings located at an end of the processed photographic film. The projections interconnect together in a mating relationship with a surface of the connection therebetween being irregularly shaped so that the film strip cannot accidently slip therebetween and become disassociated from the film clip. Each of the projections are carried by a body member with the body members being hingedly connected together and continuously biased toward the closed position. The rear end of each of the body members includes a slot to facilitate locating of the film clip on a wire or string to suspend the film within the air to facilitate drying. The film clip can be attached to the bottom of the photographic film strip to keep the suspended film strip stretched and prevent curling.

The primary objective of this invention is to construct a clip to facilitate the suspending of the processed strip of the photographic film and positively interconnect with the film without physical damage to the film in the form of warping or puncture marks. This is accomplished by projections which protrude through the notches or openings formed along the side of the film thus holding the film in the shear mode rather than applying clamping forces to the film. The clip of the present invention provides for the possibility of the processing of the film while attached to the clip since no physical contact is made on the active film surface.

Another objective of this invention is to construct the film clip of non-corrosive materials so that the rusting of the film clip is not possible and the attendent rust stains on the film cannot occur.

Another advantage of this invention is that the film clip can be readily attached and removed to supporting line or wire and, when such is supported on a line or wire, accidental dislodgement therefrom is almost impossible.

Another advantage of this invention is that the film clip is constructed of two separate members which are interconnected together with only a single mold being required to manufacture both of the members since the members are identical to each other but only located in a mirror image relationship.

DETAILED DESCRIPTION OF THE SHOWN EMBODIMENT

Figure 1:
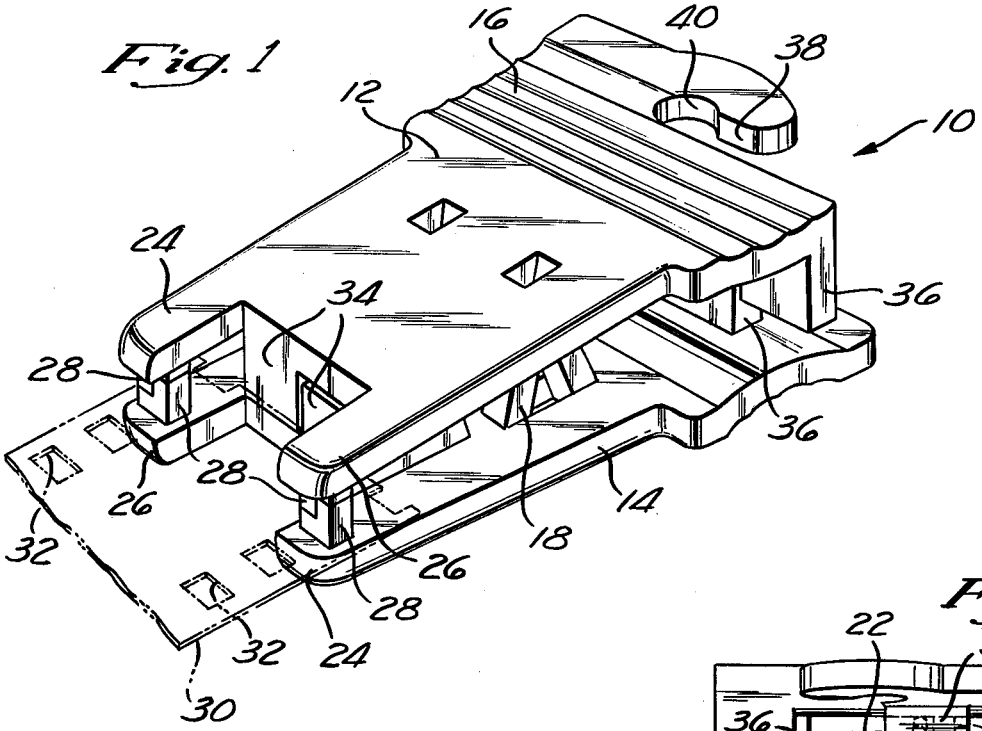
FIG. 1 is a perspective view of the film clip of this invention showing the film clip being attached to a photographic film strip shown in phantom.
Figure 2:
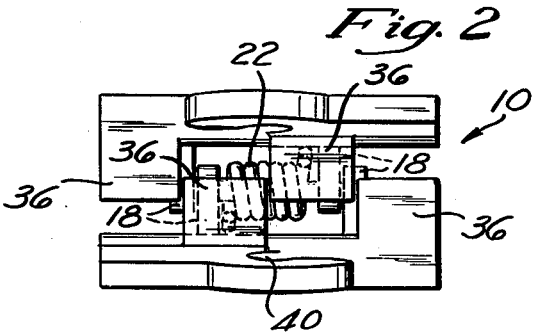
FIG. 2 is a back view of the film clip of this invention.

Referring particularly to the drawing there is shown the photographic film clip 10 of this invention which is composed of a first body member 12 and a second body member 14. Each of the body members 12 and 14 are identical in construction and are located in an interconnected, mirror image, facing relationship. The body members 12 and 14 are to be constructed of a non-corrosive material such as a plastic.

Formed on the exterior surface of each of the body members adjacent the rear end thereof are serrations 16. These serrations 16 are to function to facilitate manual grasping of the clip 10 during use.

Formed on the inner surface of each of the members 12 and 14 are a pair of spaced-apart hinge projections 18. The hinge projections 18 operate together between the members 12 and 14 so as to facilitate passage of the pin 20 therebetween. The pin 20 functions to secure together the members 12 and 14 and permit hinging movement of the members 12 and 14 between the closed position shown in the drawing and an open position.

A spring 22 is to be wound about the pin 20 the ends of which are in physical contact with the members 12 and 14. Spring 22 functions to exert a continuous bias between the members 12 and 14 tending to locate the members 12 and 14 in the closed position. To effect opening of the clip 10, the manual opening movement must overcome the force of the spring 22. The spring is to be constructed of a non-corrosive material.

The fore end of each of the members 12 and 14 is recessed to form a pair of spaced-apart leg extensions 24 and 26. Formed on the inner surface of each of the leg extensions 24 and 26 is a projection 28. Each of the projections 28 are of an identical configuration and basically comprise an L-shaped block. It is to be noted that when the members 12 and 14 are located in the closed position as shown in the drawing, the connected projections 28 cooperate together in a mating relationship. The surface of the interconnection between the connected projections 28 is irregular. This irregular surface will prevent the film strip 30 from accidently sliding past the projections 28 and therefore prevent accidental dislodgement of the film strip 30 from the film clip 10. Each pair of mated projections 28 are to be located within a notch or opening 32 located within each side of the film strip 30.

Although the irregularly shaped surface formed by the L-shaped blocks 28 is shown to be preferrable, it is considered to be within the scope of this invention the numerous other types of irregular shaped surfaces could be employed. Possible examples of different forms of irregular shaped surfaces would be a jagged type of surface or a S-shaped curved surface. A desirable form of irregular shaped surface would be one which would permit forming of the members 12 and 14 from a single mold and when the surfaces were placed in a facing relationship the surfaces mated.

Located adjacent the fore end of each of the members 12 and 14 is a projection 34. The projections 34 of the members 12 and 14 are to be located in physical contact in a side-by-side relationship. The projections 34 function to guide in the movement of the film clip 10 between the open and closed position and to provide lateral stability for the film clip 10 and prevent the members 12 and 14 from becoming laterally skewed with respect to each other.

Formed at the rear end of each of the members 12 and 14 are two spaced-apart inwardly extending projections 36. The projections 36 between the members 12 and 14 cooperate together to again provide lateral stability between the members 12 and 14. Also, the length of the projections 36 is selected so that when the film clip 10 is moved to the open position, the outer end of each of the projections 36 is to come into physical contact with the other of the members 12 or 14. This means that the projections 36 can function as a stop to limit the degree of opening movement of the film clip 10.

Figure 5:
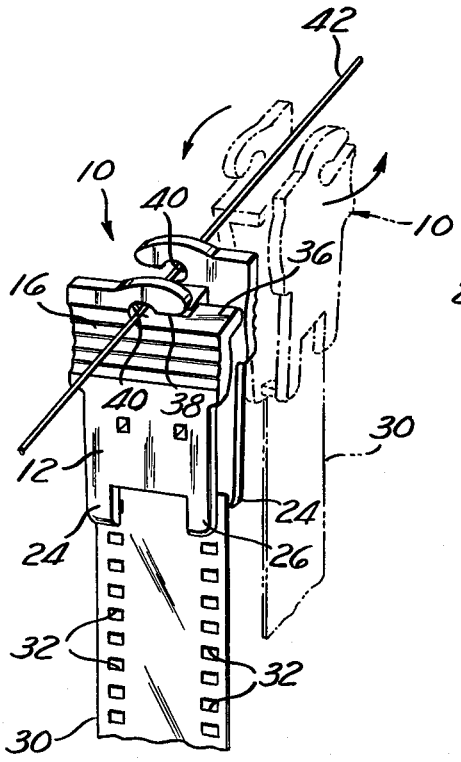
FIG. 5 is an isometric view of the film clip of this invention showing the connection of such to a photographic strip of film and the supporting of such on a wire or string.
Figure 3:
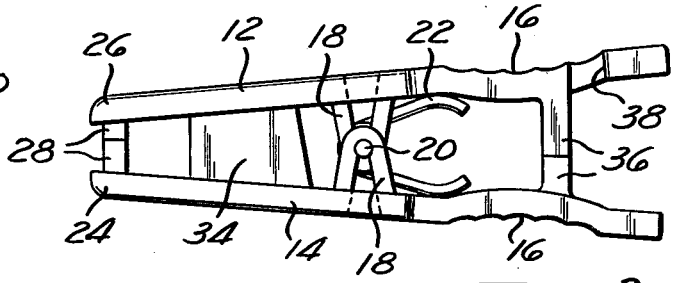
FIG. 3 is a side view of the film clip of this invention showing the film clip in the normally closed position.
Figure 4:
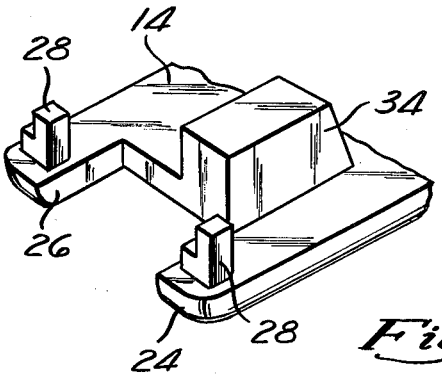
FIG. 4 is a partial perspective view of the fore end of one of the body members of the film clip of this invention showing the irregularly shaped projections which are to extend through the openings or notches formed within the film strip.

Also formed within the rear end of each of the members 12 and 14 is an elongated slot 38. The inner end of the elongated slot 38 includes an enlarged opening 40. The slots 38 as well as the enlarged opening area 40 are to function to facilitate connection of the film clip 10 to a wire or string 42. The film clip 10 is to be located as shown in phantom lines in FIG. 5 of the drawing with respect to the wire or string 42 and then turned ninety degrees causing the wire string to pass through each of the slots 38 and then be located within the enlarged opening 40. The film clip 10 must be turned ninety degrees in order to correctly associate the clip 10 with the wire or string 42. Once the string 42 is located within the enlarged openings 40 of the members 12 and 14, it would be extremely difficult to effect accidental dislodgement of the film clip 10 from the wire string 42 by reason of the fact that the wire string 42 is located within the enlarged area 40 and also a ninety degree turning movement would be required of the film clip 10 with respect to the wire string 42.

What is claimed is:

1. A clip for use primarily to suspend in the air a wet strip of recently processed photographic film to facilitate drying of the film, said clip comprising:

a pair of identical body members hingedly connected together in a facing relationship, each said body member having a fore end and a rear end with said fore end and said rear ends respectively being adjacent each other, said body members being movable in respect to each other between a closed position and an open position;

a first projection formed on each one of said members in the area of said fore end, each said first projection having an irregularly shaped outer surface, said irregularly shaped outer surfaces of said first projections cooperating together in a mating relationship when said body members are in said closed position; and a pair of second projections located on each of said body members in the area of said rear ends, said second projections extending toward the other of said body members, said second projections to contact the other of said body members when said body members are in said open position to therefore prevent further opening movement of said body members, and when said body members are in said closed position said second projections cooperate together to provide lateral stability between said body members.

2. The clip as defined in claim 1 wherein:

said identical body members being continuously spring biased toward said closed position.

3. The clip as defined in claim 2 wherein:

said identical body members being located in mirror image relationship with respect to each other.

4. The clip as defined in claim 2 wherein:

said first projections being identically shaped.

5. The clip as defined in claim 3 wherein:

said entire clip being constructed of non-corrosive materials to thereby not be effected by the chemicals used in the processing of photographic film.

6. The clip as defined in claim 5 including:

serrations formed on the outer surfaces of each of said body members in the area of said rear ends, said serrations to facilitate a manual gripping of said body members to effect movement of said body members to said open position.

7. A clip for use primarily to suspend in the air a wet strip of recently processed photographic film to facilitate drying of the film, said clip comprising:

a pair of body members hingedly connected together in a facing relationship, each said body member having a fore end and a rear end with said fore end and said rear ends respectively being adjacent each other, said body members being movable in respect to each other between a closed position and an open position;

a first projection formed on each one of said members in the area of said fore end, each said first projection having an irregularly shaped outer surface, said irregularly shaped outer surfaces of said first projections cooperating together in a mating relationship when said body members in said closed position;

said body members being continuously spring biased toward said closed position;

said body members being identical in configuration but being located in mirror image relationship with respect of each other;

said entire clip being constructed of non-corrosive materials to thereby not be effected by the chemicals used in the processing of photographic film;

serrations formed on the outer surfaces of each of said body members in the area of said rear ends, said serrations to facilitate a manual gripping of said body members to effect movement of said body members to said open position;

at least a single second projection located on each of said body members in the area of said rear ends, each said second projection extending toward the other of said body members, each said second projections to contact the other of said body members when said body members are in said open position to therefore prevent further opening movement of said body members; and third projections formed on each of said body members in the area of said fore ends, each said third projection extending toward the other of said body members, said third projections being located directly adjacent each other to therefore provide lateral stability for said body members during movement of such between said open and closed positions.

8. The clip as defined in claim 7 wherein:

a slot formed within the said rear end of each said body member, the inner end of each of said slot being slightly enlarged, whereby the said slots of each of said body members are to cooperate together to support said body members on a wire or string.

9. A clip for use in primarily to suspend in the air a wet strip of recently processed photographic film to facilitate drying of the film, said clip comprising:

a pair of body members hingedly connected together in a facing relationship, each said body member having a fore end and a rear end with a said fore end and said rear ends respectively being adjacent each other, said body members being movable in respect to each other between a closed position and an open position;

a first projection formed on each one of said members in the area of said fore end, each said first projection having an irregularly shaped outer surface, said irregularly shaped outer surfaces of said first projections cooperating together in a mating relationship when said body members are in said closed position;

said body members being continuously spring biased toward said closed position;

said body members being identical in configuration but being located in mirror image relationship with respect to each other;

said entire clip being constructed of non-corrosive materials to thereby not be effected by the chemicals used in the processing of photographic film;

serrations formed on the outer surfaces of each of said body members in the area of said rear ends, said serrations to facilitate a manual gripping of said body members to effect movement of said body members to said open position; and a slot formed within the said rear end of each said body member, the inner end of each of said slot being slightly enlarged, whereby the said slots of each said body members are to cooperate together to support said body members on a wire or string.

* * * * *